US008779996B2

(12) United States Patent
Martek et al.

(10) Patent No.: US 8,779,996 B2
(45) Date of Patent: Jul. 15, 2014

(54) LOW PROFILE, BROAD BAND MONOPOLE ANTENNA WITH HEAT DISSIPATING FERRITE/POWDER IRON NETWORK AND METHOD FOR CONSTRUCTING THE SAME

(75) Inventors: Gary A. Martek, Blythewood, SC (US); Henry R. Jarman, Gadsden, SC (US)

(73) Assignee: Shakespeare Company, LLC, Columbia, SC (US)

( * ) Notice: Subject to any disclaimer, the term of this patent is extended or adjusted under 35 U.S.C. 154(b) by 425 days.

(21) Appl. No.: 13/383,271

(22) PCT Filed: Jul. 21, 2010

(86) PCT No.: PCT/US2010/042693

§ 371 (c)(1),
(2), (4) Date: Jan. 10, 2012

(87) PCT Pub. No.: WO2011/011478

PCT Pub. Date: Jan. 27, 2011

(65) Prior Publication Data

US 2012/0112974 A1 May 10, 2012

Related U.S. Application Data

(60) Provisional application No. 61/228,318, filed on Jul. 24, 2009.

(51) Int. Cl.

| | |
|---|---|
| ***H01Q 9/00*** | (2006.01) |
| ***H01Q 5/00*** | (2006.01) |
| ***H01Q 9/30*** | (2006.01) |
| ***H01Q 1/32*** | (2006.01) |
| ***H01Q 9/36*** | (2006.01) |

(52) U.S. Cl.

CPC ..... *H01Q 1/3275* (2013.01); *H01Q 5/0041* (2013.01); *H01Q 9/30* (2013.01); *H01Q 5/0034* (2013.01); *H01Q 9/36* (2013.01)

USPC ..... 343/749; 343/715; 343/787; 343/900

(58) Field of Classification Search

CPC ..... H01Q 1/32; H01Q 1/3275; H01Q 5/0034; H01Q 5/0041; H01Q 9/00; H01Q 9/30; H01Q 9/36

USPC ..... 343/749, 715, 787, 900

See application file for complete search history.

(56) References Cited

U.S. PATENT DOCUMENTS 3,931,625 A * 1/1976 Chiron et al. ..... 343/787
4,246,586 A * 1/1981 Henderson et al. ..... 343/873

(Continued)

FOREIGN PATENT DOCUMENTS

EP 0 124 758 A1 11/1984 ..... H01Q 9/16

OTHER PUBLICATIONS

International Search Report for priority application PCT/US2010/042693 mailed Feb. 7, 2011.

*Primary Examiner* — Hoang V Nguyen
(74) *Attorney, Agent, or Firm* — Andrew B. Morton

(57) ABSTRACT

An antenna operable over a predetermined range of frequency includes a transmission line, a transformer network connected to one end of the transmission line, and at least one ferrite/powder iron network connected to an opposite end of the transformer network. The ferrite/powder iron network changes the effective electrical length of the antenna such that as the frequency of operation changes, the current distribution above and below the network changes in corresponding manner. A second ferrite/powder iron network may be serially positioned with respect to the other network, wherein both function to reduce the current thereabove. Accordingly, as the frequency of operation increases, the electrical height of the antenna decreases. The network also encompasses a way to safely dissipate otherwise destructive heat created by the operation of the antenna system at high radio-frequency power.

15 Claims, 9 Drawing Sheets

(56) References Cited

U.S. PATENT DOCUMENTS

| | | | | |
|---|---|---|---|---|
| 4,433,336 | A | 2/1984 | Carr | 343/728 |
| 5,757,332 | A | 5/1998 | Hanaoka et al. | 343/787 |
| 7,589,694 | B2 | 9/2009 | Martek et al. | 343/895 |
| 7,852,283 | B2 * | 12/2010 | Eide | 343/900 |

* cited by examiner

LOW PROFILE, BROAD BAND MONOPOLE ANTENNA WITH HEAT DISSIPATING FERRITE/POWDER IRON NETWORK AND METHOD FOR CONSTRUCTING THE SAME

CROSS-REFERENCE TO RELATED APPLICATION

This is a §371 application of International patent application number PCT/US2010/042693 filed Jul. 21, 2010, which claims the benefit of U.S. Patent application Ser. No. 61/228,318 filed on Jul. 24, 2009, and both of which are incorporated herein by reference.

TECHNICAL FIELD

The present invention relates generally to antennas used in mobile and/or military applications. More particularly, the present invention relates to a broad band antenna that provides an instantaneous bandwidth of about 482 Megahertz (MHz) between 30-512 MHz with a relatively low voltage standing wave ratio (VSWR) and high gain. Specifically, the present invention provides a monopole broad band antenna and method for constructing the same with at least one ferrite/powder iron network which effectively changes the electrical length of the antenna as the applied radio frequency signal changes in frequency/wavelength.

BACKGROUND ART

It is known that electromagnetic communication systems employ broad bandwidth techniques, such as the so-called frequency-agile or frequency-hopping systems in which both the transmitter and receiver rapidly and frequently change communication frequencies within a broad frequency spectrum in a manner known to both units. When operating with such systems, antennas having multiple matching and/or tuning circuits must be switched, whether manually or electronically, with the instantaneous frequency used for communications. As such, it is imperative to have a single antenna reasonably matched and tuned to all frequencies throughout the broad frequency spectrum of interest. Although the art discloses such broad band antennas, these antennas provide a somewhat limited frequency range.

As is well known in the art, a thin linear monopole antenna is normally used in a manner that requires its electrical length to be a quarter wavelength or 90 electrical degrees. These antennas require a ground plane, which is a large plane of sheet metal, such as a car or vehicle body made of metal, to provide the other half of the antenna. Therefore, the characteristics of the ground dependent "quarter wave" antenna are well known.

In order to enable a thin linear monopole antenna to be multi-band, the known art teaches placement of "traps," which are parallel inductors and capacitors, at various places in series with thin linear radiators (conductors). Such a construction results in a monopole that can be used for several frequencies or very narrow bands of frequencies. Unfortunately, the useful bandwidths for this type of antenna are very narrow, usually on the order of KHz or 2-3 MHz. With this in mind, it would be presumed that additional traps in series at various points with the linear radiators should produce additional bandwidth. However, the number of traps is usually limited to 2 or 3. The reason for this is that adjustment of each trap to its specific frequency or operational bandwidth is interdependent on the adjustment of all the traps within the antenna.

The main purpose of utilizing a trap is to change the electrical length of the monopole radiator as the frequency of operation is changed. Moreover, at a specific trap's operational frequency or bandwidth, the current in the linear radiator physically above the trap in question, is reduced to or near zero so that the current distribution of the radiator physically below the trap in question is approximately that of a quarter-wave monopole radiator. In view of the interdependency of each trap in order to obtain a desired frequency bandwidth, there is currently not available in the art a linear monopole antenna with a bandwidth anywhere near 482 MHz. Nor is there available an antenna with such a wide bandwidth that also has a relatively low VSWR across the bandwidth.

One solution to the aforementioned problem is the use of inductive/resistive networks which create the electrical shortening process as the applied signal frequency is increased. Such an antenna is disclosed in U.S. Pat. No. 6,429,821 which is incorporated herein by reference. The problem is that these inductive/resistive networks as implemented are not perfect and can have serious parasitic effects from stray capacitance and self resonate effects of the inductive coils and especially the resistors which have to dissipate waste power via a heat sink. These resistors have inherent shunting capacitance because of the need to be coupled closely to a heat sink, that interferes with the ideal operation of the networks. The result is that these networks of the prior art allow "blow-bye" antenna currents that degrade the intended radiation pattern of the antenna.

One significant drawback to distributed inductive/resistive networks is their design inflexibility. The inductors in these networks can be changed as needed, but the resistors must be restricted to "first-order" networks because the power resistor needs a heat sink or thermal mass to dump waste heat. The ability to select the appropriate resistor which uses the preferred "thick film" technology is difficult because of the relatively expensive and slow manufacturing process of the resistors used in such networks. Indeed, higher-order networks require several power resistors to be arranged on a heat-sink in more complicated geometries which makes design and practical application of such networks even more difficult.

One solution to the blow-bye problem is to use of ferrite/powdered iron networks in the form of toroidal cores. It is known that toroidal ferrite cores can be used to minimize high frequency noise by absorbing the excess noise or energy ultimately to the conversion of heat. Further, the ability of the toroidal ferrite to absorb radio frequency can be carefully characterized by testing to select toroidal dimensions, core material type, and integrated heat transfer medium that best mimics a perfect inductor resistor networks in a parallel configuration. In theory, it appears to be easy to match the performance of a inductive/resistive based antenna with an antenna based on ferrite cores (also referred to as beads). However, it is harder to match a ferrite bead antenna with an inductive/resistive based antenna because in some cases the inductive/resistive networks must be arranged in more complex/exotic geometries or "high order" filter configurations to realize the same amount of antenna surface current control. Concerns also arise regarding the specific composition of the ferrite material. In any event, the ferrite beads or cores are selected to be electrically similar to the lumped inductive/resistive networks, and do not suffer from the above described parasitic effects. However, the use of such toroidal cores for high power antenna designs were thought to be impractical because of severe over-heating of the cores and as a result, fracturing of these cores and/or inadvertently ruining the magnetic properties by over heating them past their Curie temperature. The present invention incorporates an integrated heat dissipative system that allows the otherwise destructive heat build up to be safely dissipated away while minimizing the side effects of the prior art's parasitic capacitance caused by the use of power resistors and the necessary close-coupled heatsink.

DISCLOSURE OF INVENTION

It is thus an object of the present invention to provide a low profile, broad band monopole antenna with heat dissipating ferrite/power iron network.

Another object of the present invention is to provide an antenna operable over a predetermined range of frequency comprising a transmission line, a linear radiator extending from the transformer network, a transformer network connected to one end of the transmission line, at least one ferrite/powder network iron disposed along the linear radiator, the at least one ferrite/powder iron network changing the effective electrical length of the antenna such that as the frequency of operation changes, the current distribution above and below the at least one ferrite/powder iron network changes in a corresponding manner, and a heat dissipative medium coupling the ferrite/powder iron network and the linear radiator.

Still another object of the present invention is to provide a method for constructing an antenna operable over a predetermined range of frequency comprising connecting a linear radiator to a transmission line, selecting a configuration of at least one ferrite/powder iron network according to desired operational properties, positioning the at least one ferrite/powder iron network on the linear radiator, and coupling the at least one ferrite/powder iron network to the linear radiator with a heat dissipative medium.

These and other objects of the present invention, as well as the advantages thereof over existing prior art forms, which will become apparent from the description to follow, are accomplished by the improvements hereinafter described and claimed.

BRIEF DESCRIPTION OF THE DRAWINGS

For a complete understanding of the objects, techniques and structure of the invention, reference should be made to the following detailed description and accompanying drawings, wherein.

BEST MODE FOR CARRYING OUT THE INVENTION

Figure 1A:
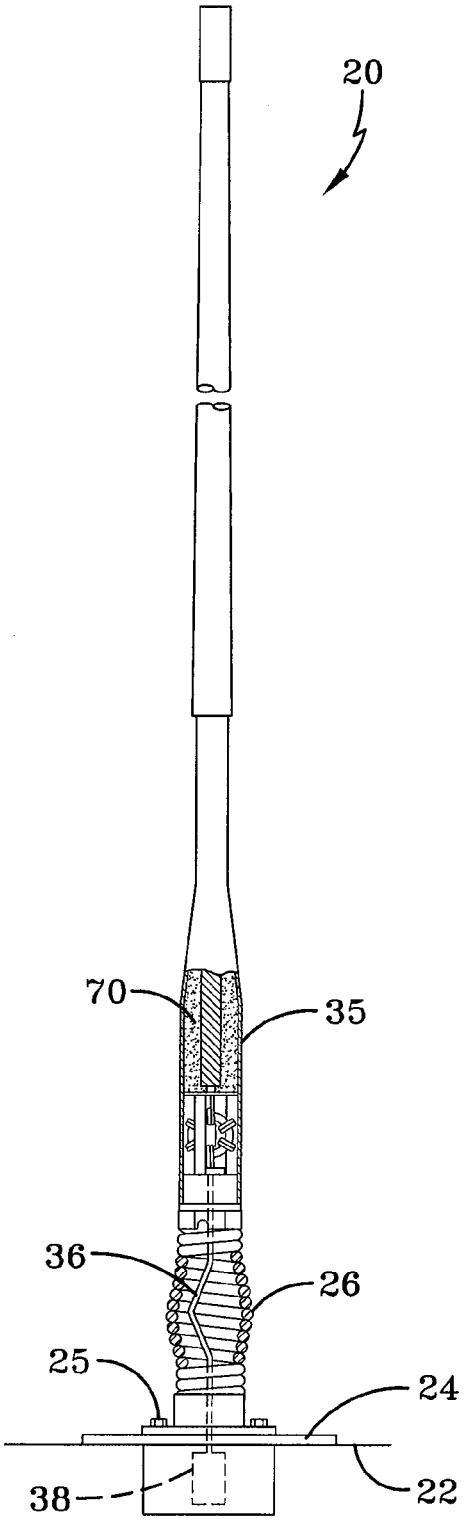
FIG. 1A is an elevational view, in partial cross-section, of an exemplary antenna according to the concept of the present invention.
Figure 2A:
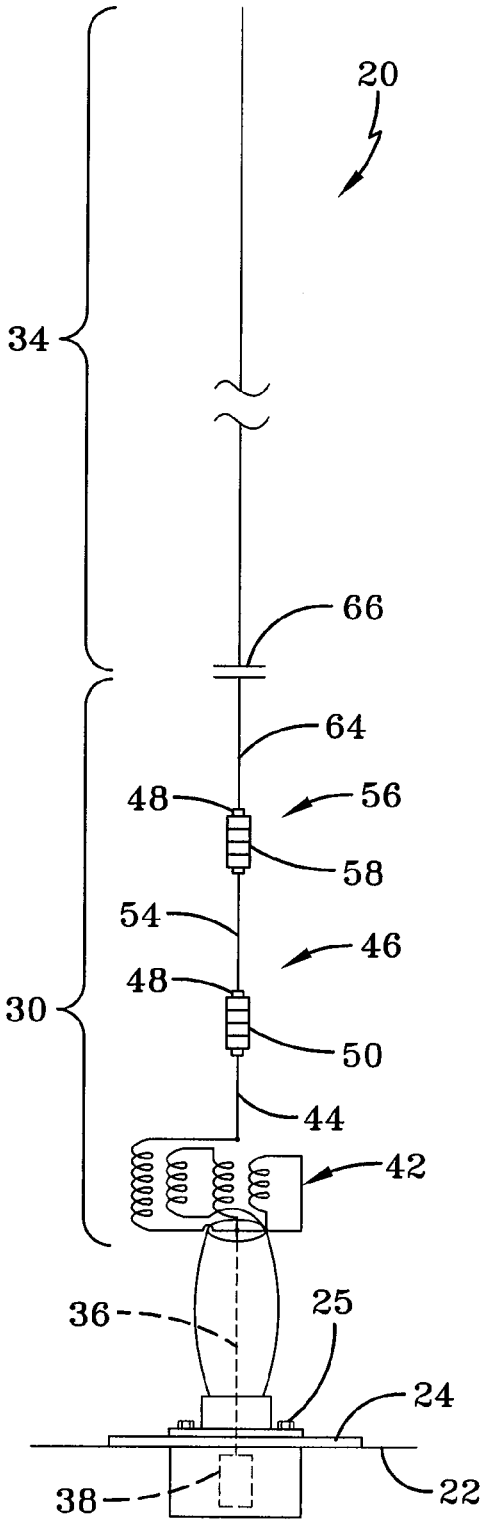
FIG. 2A is a schematic diagram of the electrical mode for the exemplary antenna depicted in FIG. 1A.

Referring now to the drawings and, in particular, to FIGS. 1A and 2A, a broad band antenna according to the present invention is generally indicated by the numeral 20. The antenna 20 is vertically secured to a mounting plane 22 which provides a sufficient ground plane, such as a military vehicle or the like. The antenna of the preferred embodiment is employed for ground-to-ground, ground-to-air communications, and, as will become apparent later, for satellite communication. The antenna 20 is secured to the mounting plane 22 by a base plate 24 with a plurality of fasteners 25 in a manner well known in the art. Extending substantially vertically from the base plate 24 is a spring assembly 26 which provides a flexible mounting for the antenna 20. The spring assembly 26 is preferably made of a corrosion-resistant steel, and is mechanically connected to the base plate 24 and the components of the antenna so as to withstand any flexure forces applied to the antenna.

Extending vertically from the spring assembly 26, in a direction away from the base plate 24, is a base radiator generally indicated by the numeral 30 and a tip radiator generally indicated by the numeral 34. Both the base radiator 30 and the tip radiator 34 are enclosed within a tapered cylindrical radome 35. The radome 35 is made of a non-conductive material such as fiber reinforced plastic and is enclosed within a fiberglass or plastic cover laminate.

A transmission line 36 which, in the preferred embodiment, is a length of 50 ohm characteristic impedance transmission line about 7 inches in length, is terminated at one end by a connector 38 typically used with 50 ohm transmission line such as SO239, BNC or a type N connector. The connector 38 is mounted to the base plate 24 and allows for connection to other transmitting or receiving equipment that utilizes the operational characteristics of the antenna 20.

The base radiator 30 may include a unun transformer 42 connected to the transmission line 36 at an end opposite the connector 38. In one embodiment, the transformer is a Guanella 1:4 unun transmission line transformer. The transformer 42 transforms the feed point impedances of the antenna to impedances that meet the VSWR operational requirements of the antenna 20. Those skilled in the art will appreciate that the transformer includes a ferrite core. Selection of the ferrite core size, shape, and material depends upon the frequency range and VSWR requirements desired by the end-user and is easily done by one skilled in the art. Published material such as *Transmission Line Transformers* by Jerry Sevick, published by the American Radio Relay League, is quite helpful in such selection.

Figure 3:
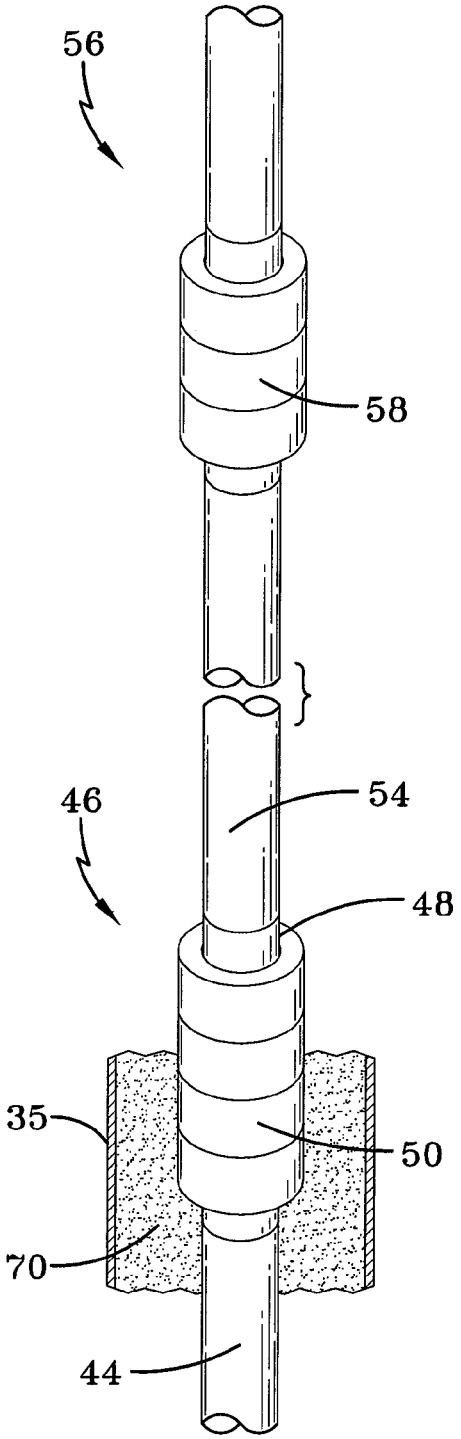
FIG. 3 is a perspective view of an antenna with two heat dissipating ferrite/powder iron networks according to the present invention.
Figure 4:
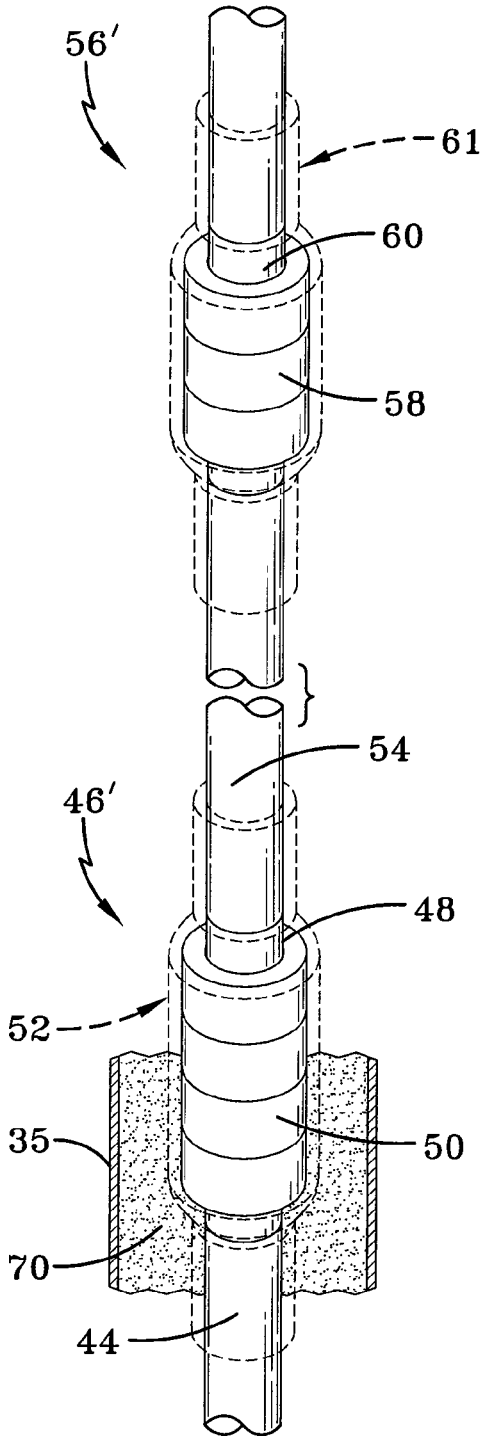
FIG. 4 is a detailed view of the heat dissipating ferrite/powder iron network according to the present invention.

Extending vertically from the transformer 42 are a series of linear radiators and electrical component networks which function in such a manner that as the frequency of operation changes, the effective impedance of the networks change instep and instantaneously to limit the antenna current(s) that exist above those networks; therefore, as the frequency of operation increases, the electrical height of the antenna in effect decreases. To accomplish this, the base radiator 30 includes a linear radiator 44 extending vertically from the transformer 42 and which is electrically connected to a heat dissipating ferrite/powder iron network 46. The network 46 includes at least one ferrite core 50 axially disposed over the linear radiator 44. Interposed between an inner diameter of the core 50 and an outer diameter of the radiator 44 is an inner heat dissipating medium 48. The medium may be configured in any number of ways and includes but is not limited to a heat-conductive paste, a heat-conductive tape, a ceramic tube comprising Beryllium-Oxide, or other such material that intervenes the space between the inside of the toroidal core and the outside of the antenna element to carry the heat to the radiators 44/54 which is usually a brass tube, which acts as an effective heat-sink over the entire length of the antenna. The heat dissipating medium also assists in positioning the core in a desired linear position from the transformer 42. The proper heat dissipating medium type and thickness or gap is selected through an "iterative selection process" that minimizes parasitic side-effects while maximizing heat transfer effectiveness. As best seen in FIGS. 3 and 4, it will also be appreciated that the medium 48 may extend along the length of the radiator past the ends of the core or cores 50. The extended length is believed to assist in further dissipating heat generated by the core during operation of the antenna. To further dissipate the heat an additional and separate outer heat dissipative medium 52 may be disposed over the core 50 and the medium 48. The medium 52 covers the outer diameter or surface of the core or cores 50. As such, excess heat generated by the core that emanates outwardly is transferred by the medium 52 on to the adjacent linear radiator(s). In an exemplary embodiment, the medium 52 is an adhesive and encapsulant-lined dual-wall shrink tube such as provided by Tyco Raychem. In addition to providing a heat sink feature, the tubing positions and protects the network from impact forces experienced with a tactical antenna of this type in its application. In some embodiments just the outer head dissipative medium 52 may be employed.

The aforementioned iterative process consists of putting candidate networks with the associated heat dissipative structure into a transmission line test fixture connected to a Vector-Network Analyzer (VNA) calibrated to measure the "S21" transmission parameter. The fixture establishes a "stable" TEM01 radiation mode in the presence of the candidate network, allowing "curve-fitting" or matching of the candidate network to an ideal (computer-generated) transmission scatter parameter S21 of an "ideal" resistor-inductor. The importance of these networks can be appreciated by the fact that by their proper selection, they allow a designer to control the overall antenna current profile as a function of applied frequency. The integral of this current results in the far-field radiation pattern of the antenna system. Further, the refined optimization process described above has effectively eliminated the need for expensive solid brass heat sinks that are deployed over the length of the antenna in the design of the prior art, and thus the need for labor intensive soldering to affix these heat sinks to the brass tubes making up the antenna. This antenna is thus simpler to build and very cost effective compared to the prior art. And the antenna provides near exact matching of the prior art antenna system if needed by the end user as shown in this application or, improved, performance over the prior art by allowing the optimization of sub-bands of frequencies within the overall bandwidth. The lower VHF band can be optimized compared to the higher UHF or visa-versa for both gain and VSWR (Matching) by establishing "target" antenna current profiles from antenna modeling software that model a desired far-field radiation pattern.

As seen in FIG. 3, extending vertically from network 46 is another linear radiator 54 which may have connected to its opposite end another heat dissipating ferrite/powder iron network 56. The network 56 is configured in much the same manner as the network 46 and includes at least one ferrite core 58 and an inner heat dissipating medium 60. An outer heat dissipating medium 61, much like the medium 52, may be disposed over the cores 58 and the medium 60. In some embodiments, just the medium 61 may be disposed over the cores 58. The networks 46 and 56 may be spaced apart and positioned a predetermined distance from one another so as to achieve the desired operational performance through precise antenna current control. As seen in FIG. 4, a network 46' may include an outer heat dissipating medium 52 disposed over the core or cores 58 and the heat dissipating medium 48. Any number of cores 50, 58 could be used to obtain the desired operational performance. In one embodiment, two cores of TDK (Garden City, N.Y.) HF 40 T are used for the network 56 and two cores of TDK HF 40 T are used for the network 46. In another embodiment, five cores of Amidon (Costa Mesa, Calif.) FT-61 are used for the network 56 and four cores of FT-61 are used for the network 46. As will be appreciated, the composition of the ferrite beads is basically an iron oxide combined with a binder of compounds such as nickel, manganese, zinc or magnesium that make up each bead. Use of particular materials is selected based upon the desired operational properties of the antenna.

Vertically extending from the network 56 is another linear radiator 64. Those skilled in the art will appreciate that the linear radiators 44, 54, and 64 are typically brass tubes. In the preferred embodiment, the brass tube radiators have an outer diameter of 0.500 inches with a 0.014 inch wall thickness. Alternatively, the radiators could be constructed of a plurality of wires or conductors braided or spirally served around a core of dielectric material.

Extending from the linear radiator 64 is the tip radiator 34. A tip capacitor 66 is interposed between the linear conductor 64 and the tip radiator 34. In one embodiment, the tip capacitor has a value of 4 pf. The tip capacitor 66 provides a safety factor for whenever the antenna 20 contacts a high voltage power line. The capacitor 66 and the fiberglass cover surrounding the tip radiator 34 provide a breakdown voltage of about 20 KV rms, 60 Hz for personnel and/or equipment associated with the ground plane carrying the antenna 20.

Figure 1B:
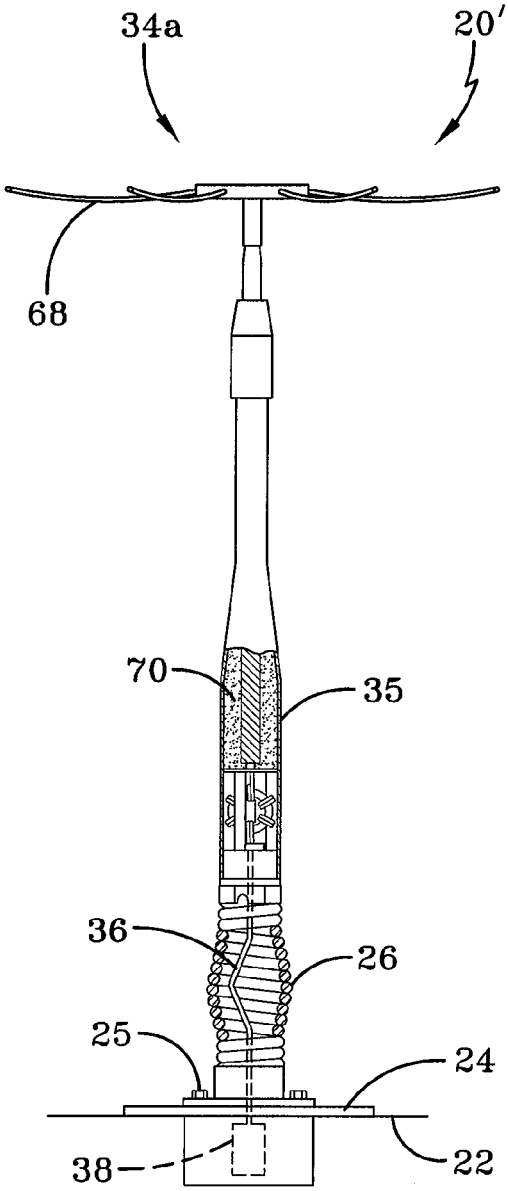
FIG. 1B is an elevational view, in partial cross-section, of an exemplary antenna according to the concepts of the present invention which employs an antenna shortening "top-hat;"
Figure 2B:
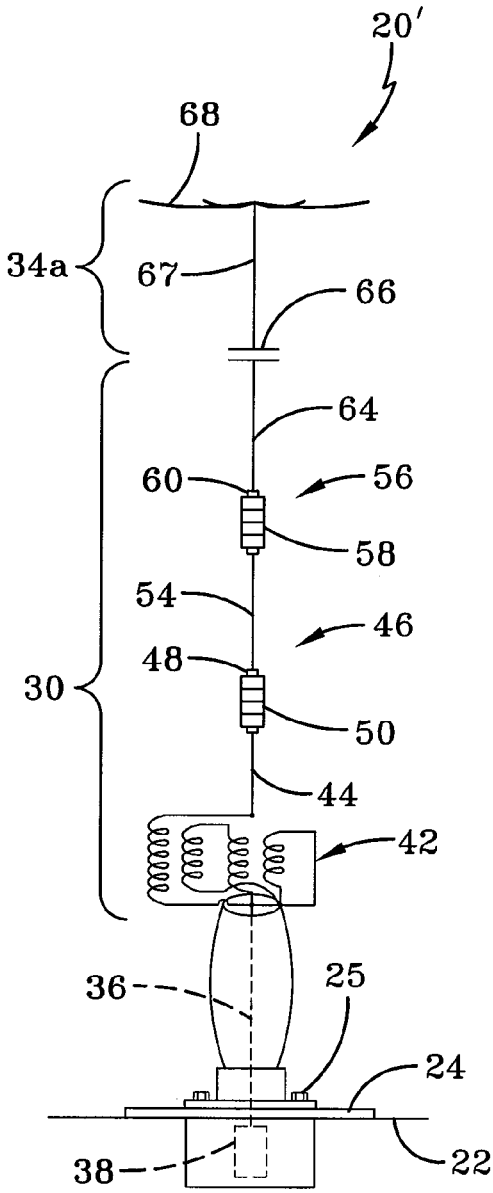
FIG. 2B is a schematic diagram of the electrical mode of the exemplary antenna depicted in FIG. 1B that shows the incorporation of the "top-hat;"

In an alternative embodiment of the antenna shown in FIGS. 1B and 2B and designated generally by the numeral 20', it can be seen that the tip radiator 34 may be substituted with a "top hat" 34*a*. Structurally, instead of the tip radiator 34 having an extended length, the top hat 34*a* includes a shortened axially extending conductive tube 67 extending from a distal end of the radiator 30 that terminates at a plurality of radially extending conductive arms 68. The tube and arms may extend from an end of the radome and they may be encapsulated by protective tubing. In one embodiment 6 arms are utilized, but any number of arms could be provided. The antenna 20' is suitable for use in deployment scenarios where a short profile mounting is needed such as on a tank or armored vehicle.

Positioning of the networks is obtained by the frictional interface between the radiators, the selected heat dissipative medium and the core. Network positioning may also be achieved by use of adhesives or mechanical clamping devices. And, as previously noted, the medium 52 can serve to position and protect the network. Indeed, either or both of the inner and outer heat dissipative mediums create an envelope around the ferrite/powder iron networks extending above and below the networks contacting the linear radiator at the terminus of the networks.

Positioning of the networks may be adjusted so as to obtain a desirable VSWR and/or gain characteristic of the antenna.

Once the networks are positioned and assembled on the radiators, the assembly is inserted into the radome 35 and a foam material is received therein. The foam material 70 expands and holds the networks and any other components in place. Various methods may be used to encase the components in the foam material. If desired, ferrules or other retaining features may be used to secure the positioning of the networks.

With the foregoing structure of the antenna 20, it will be appreciated that the networks 46 and 56, along with their positional placement within the base radiator 30, provide the effective electrical lengths and current distribution changes needed to obtain the desired bandwidth of the antenna 20.

It will be appreciated that as the frequency of the operation changes, the effective impedance of the networks 46 and 56 change instep and instantaneously in a way to limit the antenna current(s) that exist above those networks. Therefore, as the frequency of operation increases, the electrical height of the antenna effectively decreases. It will be appreciated by those skilled in the art that positional adjustment of the networks within the base radiator 30 and changes to the values of the components 50 and 58 correspondingly adjust the antenna's performance within the desired operating band. Of course, additional networks could be positioned along the length of the antenna. In one embodiment, the network 46 is positioned about 30 inches from the mounting plane and network 56 is positioned about 42 inches from the mounting plane. Accordingly, a change of network values and their placement along the antenna 20 could be adjusted such that the radiator pattern maximum load could be elevated (not along the line of sight) for ground to satellite communication.

Figure 5:
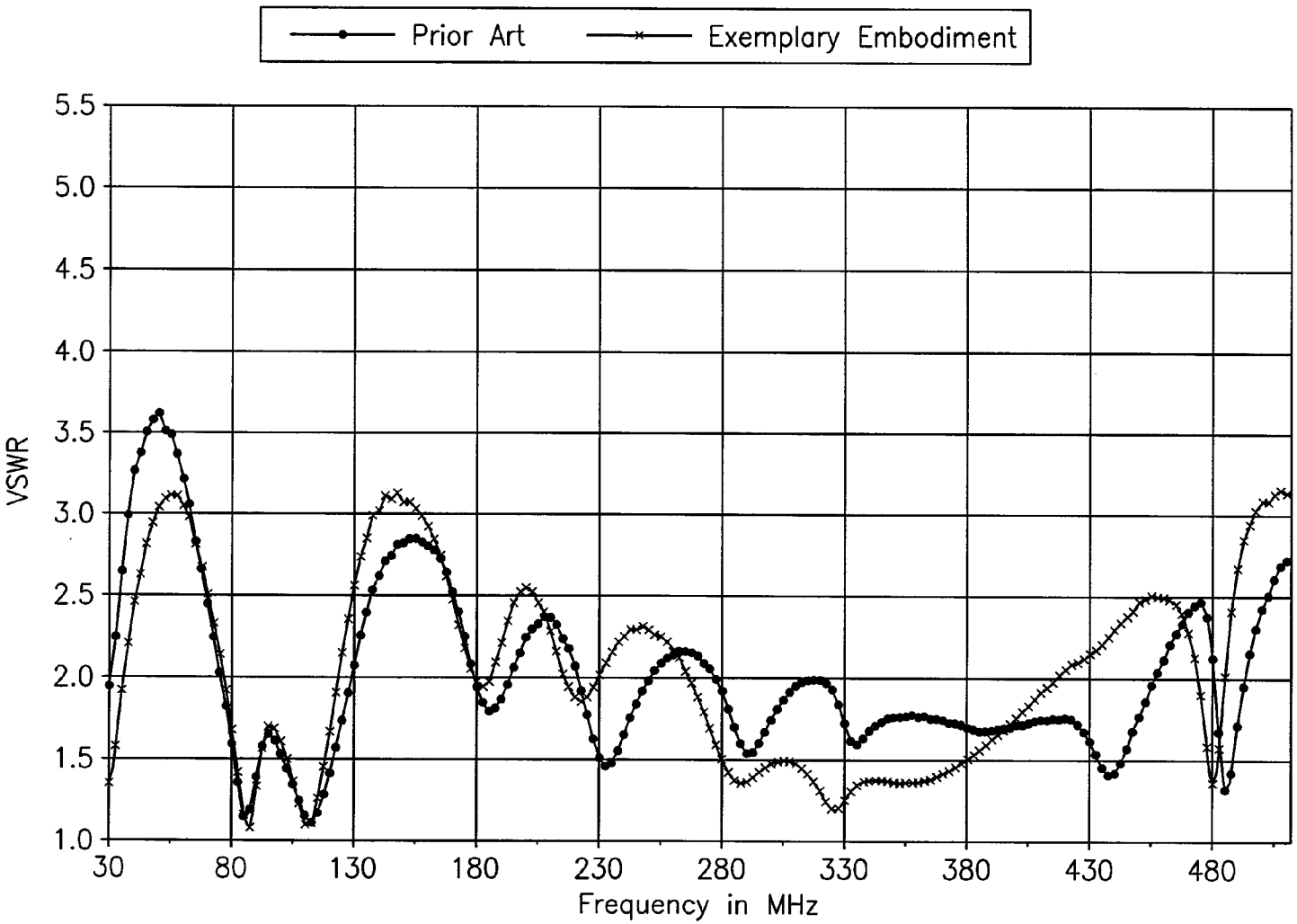
FIG. 5 is a plot of the VSWR versus frequency for the antenna of the present invention in comparison to a prior art antenna.
Figure 6:
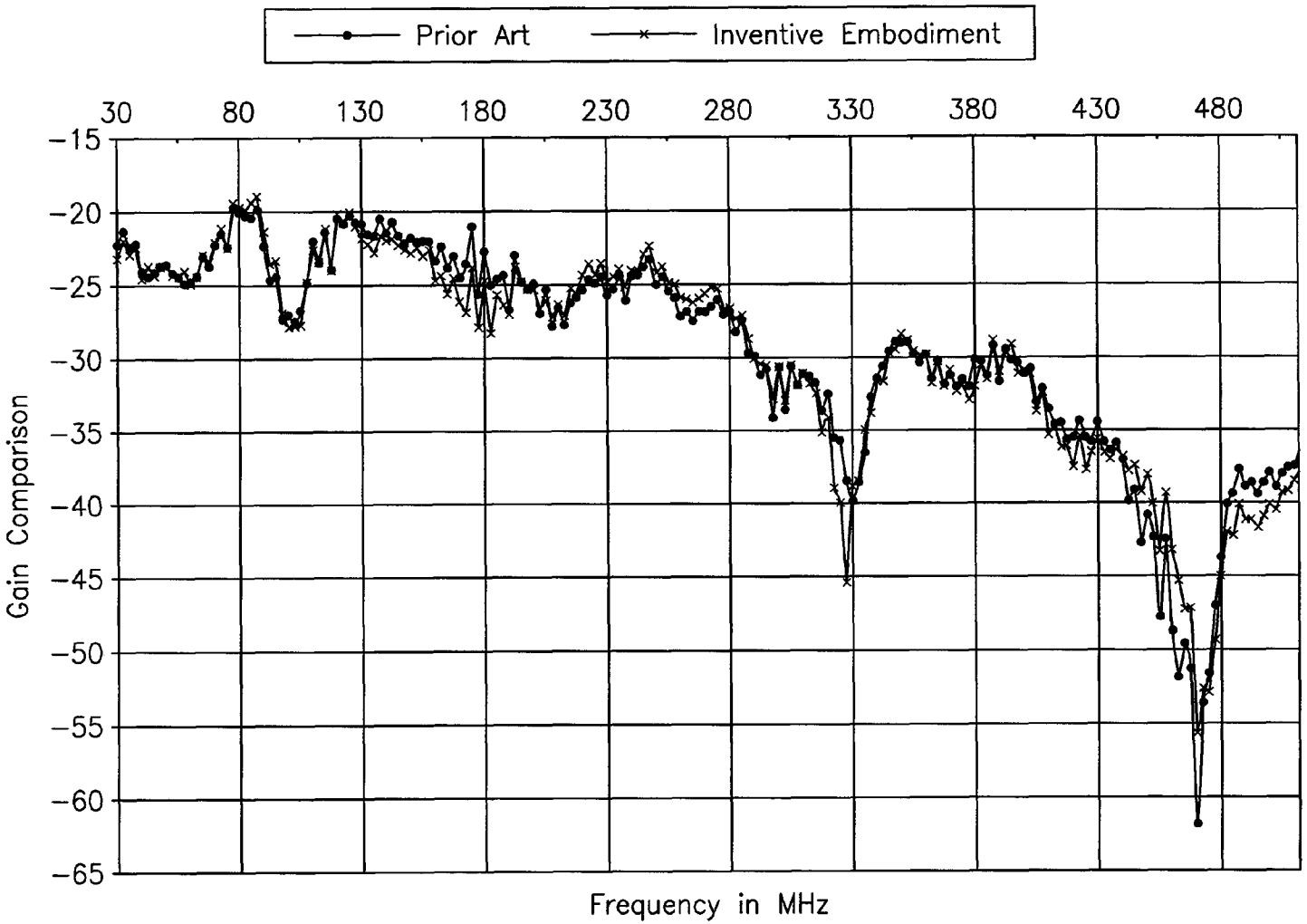
FIG. 6 is a plot of the Gain versus frequency for the antenna of the present invention in comparison to a prior art antenna.

FIG. 5 shows a VSWR comparison of a prior art resistor/inductor network antenna with an antenna made according to the present invention. FIG. 6 shows a Gain comparison of a prior art resistor/inductor network antenna made according to the present invention. As can be seen from these Figures, the present invention antenna provides a comparable performance but without the deleterious side effects as previously noted. Moreover, the disclosed exemplary antenna provides the advantages as discussed herein at a much lower cost than the prior art construction.

Figure 7A:
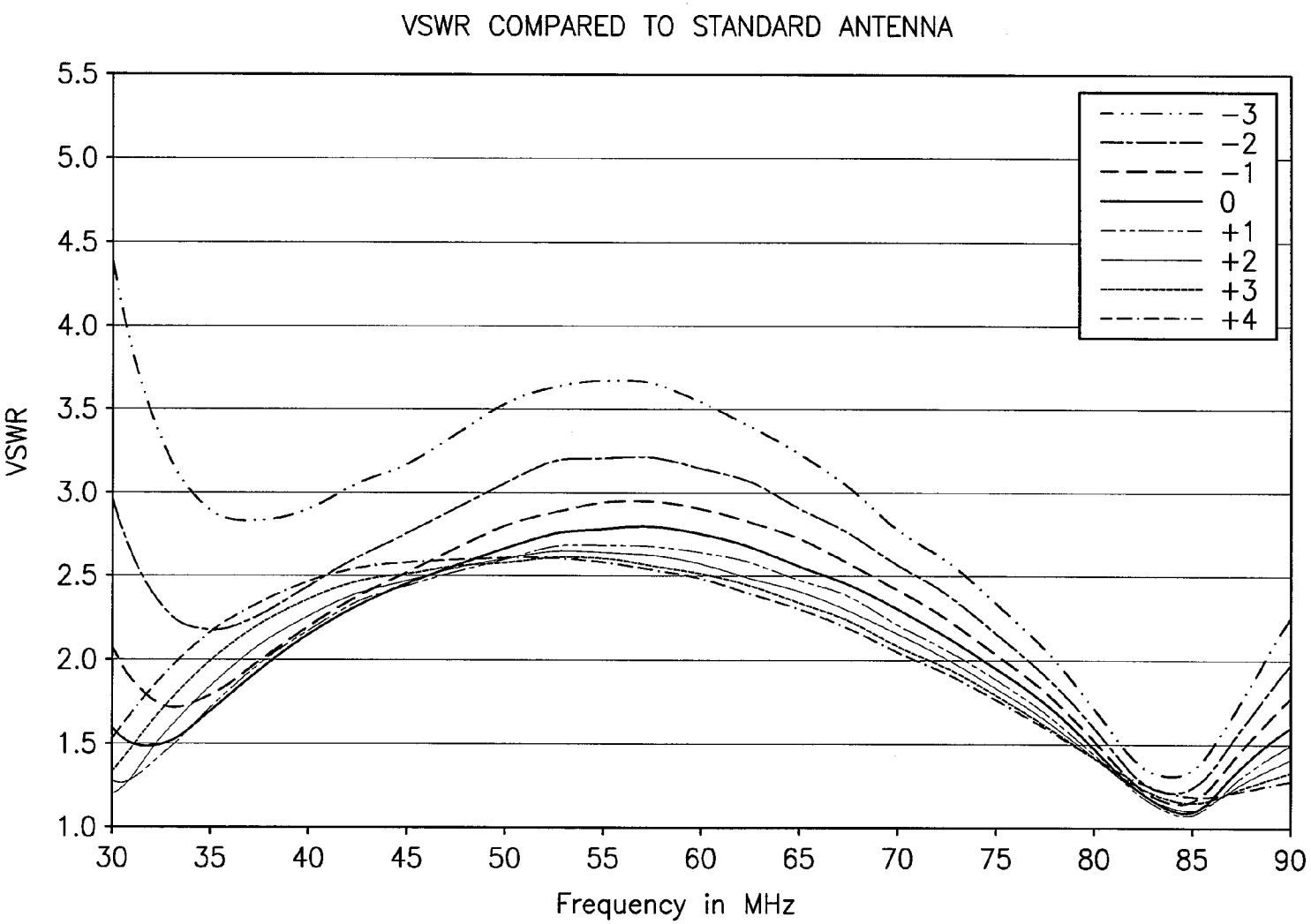
FIGS. 7A and 7B are plots of VSWR versus frequency comparing antennas that utilize different numbers of ferrite beads in the networks according to the present invention.
Figure 7B:
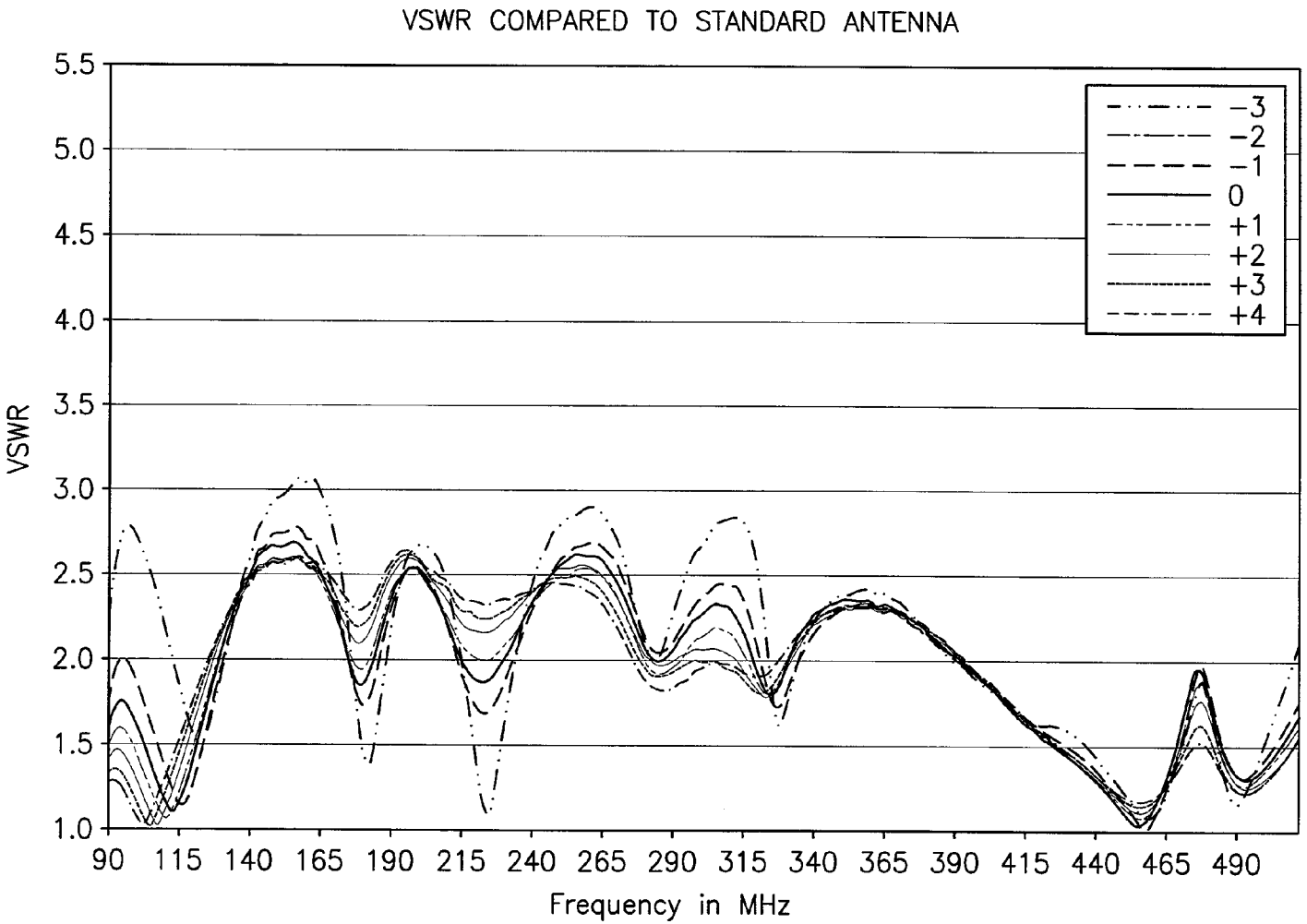

FIGS. 7A and 7B show a VSWR comparison of the various different embodiments which vary the number of beads in each network shown according to the Table I provided below.

TABLE I

| Embodiment | NETWORK 56 Number of Beads | NETWORK 46 Number of Beads |
|---|---|---|
| A | 2 | 1 |
| B | 3 | 2 |
| C | 4 | 3 |
| D* | 5 | 4 |
| E | 6 | 5 |
| F | 7 | 6 |
| G | 8 | 7 |
| H | 9 | 8 |

Figure 8A:
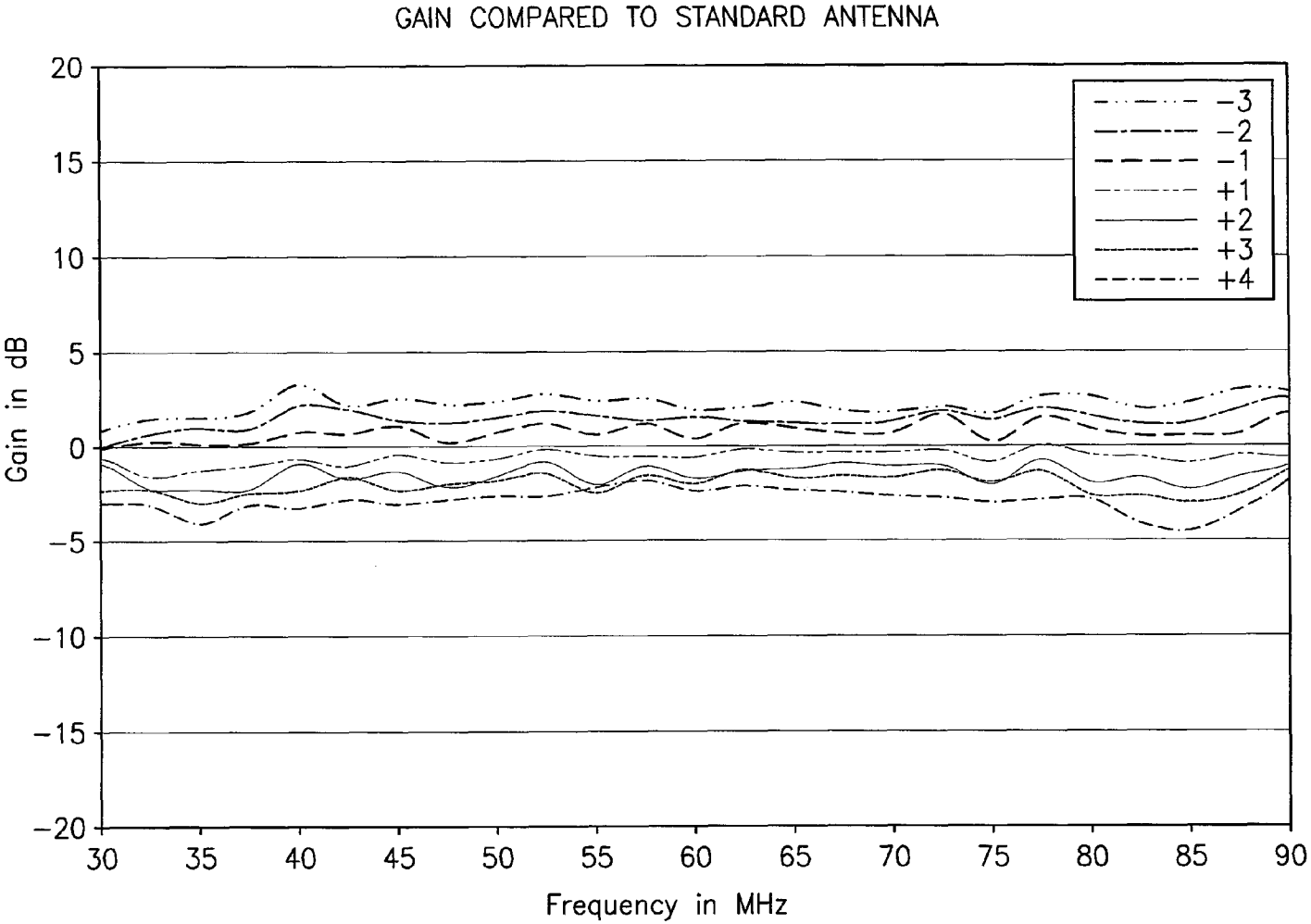
FIGS. 8A and 8B are plots of gain for antennas that utilize different numbers of ferrite beads in the networks according to the present invention.
Figure 8B:
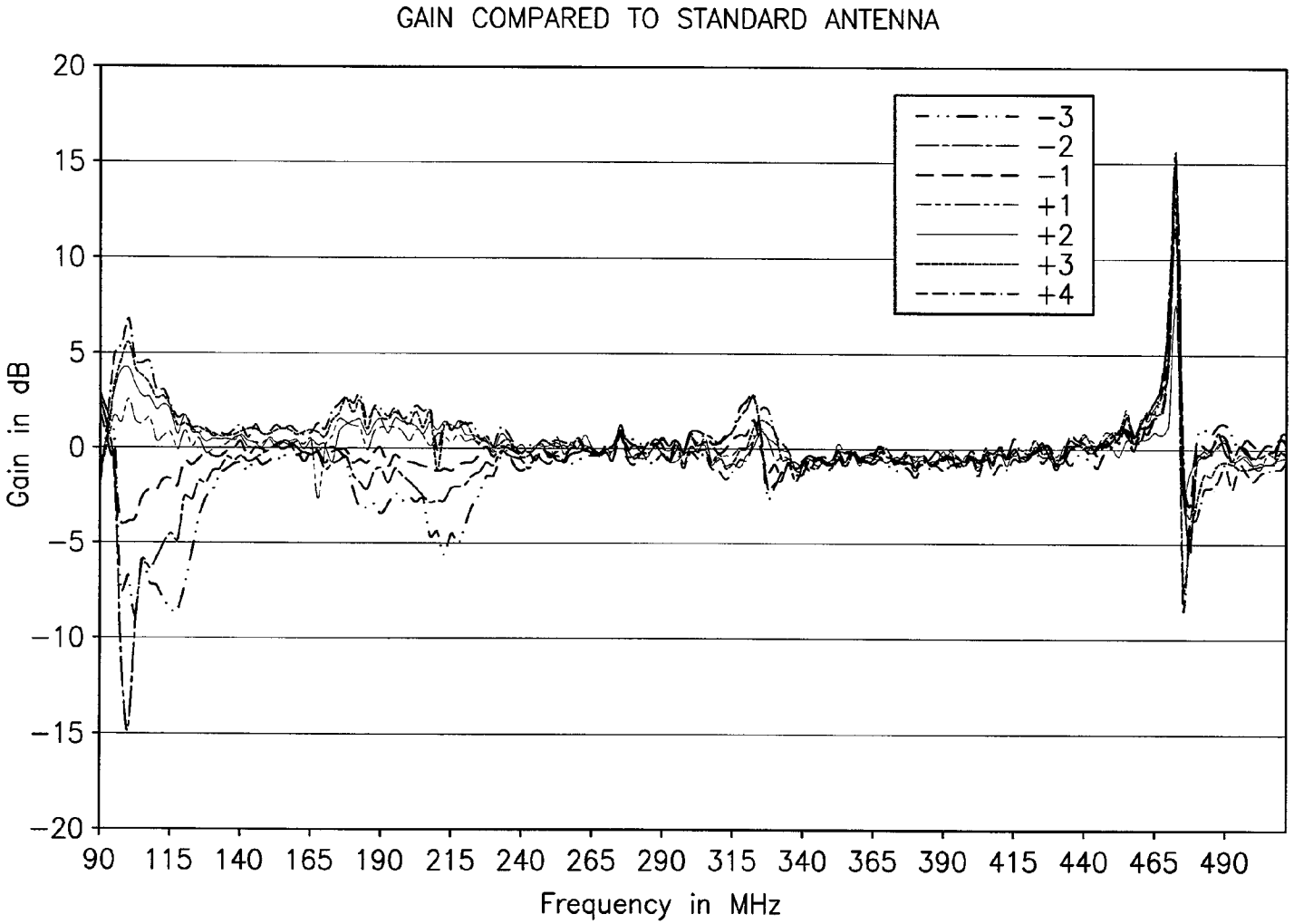

Utilizing embodiment D as a baseline, wherein embodiment D employs 5 ferrite beads in network 56 and 4 ferrite beads in network 46 and wherein all of the beads are Amidon as indicated above, the VSWR results can be seen in FIGS. 7A and 7B. FIGS. 8A and 8B provide a somewhat similar comparison for the gain results wherein all the other embodiments are compared to the embodiment D. As should be evident upon reviewing FIGS. 7 and 8, adding beads improves the matching of voltage standing wave ratio at the cost of antenna gain, at least between 30 and 90 MHz, with the exception of 30 to 50 MHz where adding more beads seems to degrade the VSWR slightly. At the higher frequency band of 90 to 500 MHz, especially 90 to about 250 MHz, both gain and VSWR are improved with more beads. It is believed that additional beads reduce the unwanted antenna currents in the upper portion of the antenna, allowing the lower portion of the antenna to radiate "more cleanly." This is desired for the higher portion of the bands, where the lower portion of the band would ideally "only" radiate. The ability to add or remove beads respective of their positions in the antenna assembly allows the designer to enhance or diminish the overall antenna performance on specific bands of frequencies based on particular needs of an end use. It will further be appreciated the selection of the particular ferrite core materials may also have an effect on the overall performance of the antenna.

Based upon the foregoing, the advantages of the present invention are readily apparent. Primarily, the antenna 20 provides an instantaneous bandwidth of 482 MHz between the frequencies of 30-512 MHz. Moreover, this construction provides a VSWR of less than 4:1 for the VHF band (30-108 MHz) and a VSWR of less than 3.2:1 across the UHF band (108-512 MHz). Accordingly, use of the antenna 20 eliminates the need for special tuning circuits or the like and greatly improves the ability of transmitters and receivers to function without the need for tuning and other modifications.

The present invention is advantageous in that the prior art's selection of inductive/resistive values, which allow the intended broadband design of the antenna, can be effectively substituted with ferrite/powder iron networks but without the performance robbing parasitic effects of the prior art's resistor-inductor networks. The parallel inductive/resistant networks used by the prior art are low-pass filters to which the values of the components establish a "roll-off" rate of attenuation that help control undesired antenna currents that affect antenna pattern quality i.e., the reduction of unwanted antenna radiation pattern skewing. As described before, the electrical effectiveness of these inductive/resistive networks are compromised by parasitic effects, this allows some "undesired" antenna currents to get-by these networks. Through a certain transmission line test fixture, ferrite/powder iron networks with the heat dissipative medium can be selected to mimic the intended "perfect" low-pass filter effect. By keeping the network and specifically the cores "cool," the core's magnetic properties are not altered nor are the cores fractured by excessive heat.

Inasmuch as the present invention is subject to many variations, modifications and changes in detail, some of which have been expressly stated herein, it is intended that all matter discussed throughout this entire specification was shown in the accompanying drawings being interpreted as illustrative and not in a limiting sense. It should thus be evident that a device constructed according to the concepts of the present invention and reasonable thereto, will accomplish the objects of the present invention and otherwise substantially improve the broad band antenna art.

What is claimed is:

1. An antenna operable over a predetermined range of frequency, comprising:

a transmission line;

a linear radiator extending from said transmission line;

a transformer network connected between said transmission line and said linear radiator;

at least one ferrite/powder iron network disposed along said linear radiator, said at least one ferrite/powder iron network changing the effective electrical length of the antenna such that as the frequency of operation changes, the current distribution above and below said at least one ferrite/powder iron network changes in a corresponding manner; and a heat dissipative medium coupling said ferrite/powder iron network and said linear radiator.

2. The antenna according to claim 1, wherein said heat dissipative medium is interposed between said ferrite/powder iron network and said linear radiator.

3. The antenna according to claim 2, wherein said heat dissipative medium is selected from the group consisting of heat-conductive paste, a heat conductive-tape, a ceramic tube comprising beryllium-oxide, and any combination thereof.

4. The antenna according to claim 3, wherein said heat dissipative medium further comprises an adhesive and encapsulate-lined dual-wall shrink tube disposed over said ferrite/powder iron network and said linear radiator and said interposed heat dissipative medium.

5. The antenna according to claim 4, further comprising:

a capacitive top-hat with radially extending arms extending from a distal end of said linear radiator.

6. The antenna according to claim 1, wherein said heat dissipative medium surrounds and extends over said ferrite/powder iron network.

7. The antenna according to claim 6, wherein said heat dissipative medium comprises an adhesive and encapsulate-lined dual-wall shrink tube.

8. The antenna according to claim 7, wherein said heat dissipative medium is also interposed between said ferrite/powder iron network and said linear radiator and wherein said interposed heat dissipative medium is selected from the group consisting of heat-conductive paste, a heat conductive-tape, a ceramic tube comprising berilium-oxide, and any combination thereof.

9. The antenna assembly according to claim 8, further comprising:

a capacitive top-hat extending from a distal end of said linear radiator.

10. A method for constructing an antenna operable over a predetermined range of frequency comprising:

connecting a linear radiator to a transmission line;

selecting a configuration of at least one ferrite/powder iron network according to desired operational properties;

positioning said at least one ferrite/powder iron network on a linear radiator; and coupling said at least one ferrite/powder iron network to said linear radiator with a heat dissipative medium.

11. The method according to claim 10, further comprising:

disposing said heat dissipative medium between said at least one ferrite/powder iron network and said linear radiator.

12. The method according to claim 11, further comprising:

disposing another heat dissipative medium around said at least one ferrite/powder iron network and said linear radiator.

13. The method according to claim 10, further comprising:

disposing a heat dissipative medium around said at least one ferrite/powder iron network and said linear radiator.

14. The method according to claim 13, further comprising:

disposing another heat dissipative medium between said at least one ferrite/powder iron network and said linear radiator.

15. The method according to claim 10, further comprising:

assembling a capacitive top-hat antenna with radially extending arms to a distal end of said linear radiator.

* * * * *